US010883504B2

(12) United States Patent
Tajima et al.

(10) Patent No.: US 10,883,504 B2
(45) Date of Patent: Jan. 5, 2021

(54) COMPRESSION DEVICE

(71) Applicant: Kobe Steel, Ltd., Hyogo (JP)

(72) Inventors: Masahiro Tajima, Takasago (JP); Yuichi Masuda, Takasago (JP); Shugo Takaki, Takasago (JP); Keita Ochiai, Takasago (JP); Hisanori Goto, Takasago (JP); Hirofumi Saito, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 230 days.

(21) Appl. No.: 16/117,667

(22) Filed: Aug. 30, 2018

(65) Prior Publication Data

US 2019/0072093 A1 Mar. 7, 2019

(30) Foreign Application Priority Data

Sep. 6, 2017 (JP) ..... 2017-171004

(51) Int. Cl.
*F04C 27/00* (2006.01)
*F04C 29/00* (2006.01)
(Continued)

(52) U.S. Cl.
CPC ..... *F04C 27/009* (2013.01); *F04C 18/16* (2013.01); *F04C 29/0007* (2013.01);
(Continued)

(58) Field of Classification Search
CPC .... F04C 27/009; F04C 18/16; F04C 29/0007; F04C 29/0014; F04C 29/021;
(Continued)

(56) References Cited

U.S. PATENT DOCUMENTS 4,394,113 A * 7/1983 Bammert ..... F04C 29/02 418/201.2
6,095,780 A * 8/2000 Ernens ..... F16J 15/002 418/104
(Continued)

FOREIGN PATENT DOCUMENTS

EP 0859154 A1 8/1998
JP S52-041480 U1 3/1977

OTHER PUBLICATIONS

Extended European Search Report issued by the European Patent Office dated Jan. 31, 2019, which corresponds to EP18191375.7-1004 and is related to U.S. Appl. No. 16/117,667.

*Primary Examiner* — Connor J Tremarche
(74) *Attorney, Agent, or Firm* — Studebaker & Brackett PC

(57) ABSTRACT

A compression device includes: a compressor including a casing, a rotor that is housed in a rotor chamber inside the casing and compresses gas by rotating, a bearing that is provided inside the casing and supports a rotor shaft so that the rotor is rotatable, and a first shaft-sealing part and a second shaft-sealing part that are provided to line up between the rotor chamber and the bearing in the casing to seal a periphery of the rotor shaft; a first supply line adapted to supply injection oil to the rotor chamber; a second supply line that is provided independent of the first supply line to supply lubrication oil to the bearing; a third supply line adapted to supply sealing gas to the first shaft-sealing part; and a fourth supply line adapted to supply the second shaft-sealing part with sealing oil to be used for sealing.

13 Claims, 8 Drawing Sheets

(51) Int. Cl.
*F04C 29/02* (2006.01)
*F04C 18/16* (2006.01)
*F04C 2/16* (2006.01)

(52) U.S. Cl.
CPC ..... *F04C 29/0014* (2013.01); *F04C 29/021* (2013.01); *F04C 29/026* (2013.01); *F04C 2/16* (2013.01); *F04C 2240/20* (2013.01); *F04C 2240/30* (2013.01); *F04C 2240/50* (2013.01); *F04C 2240/52* (2013.01); *F04C 2270/18* (2013.01); *F04C 2280/04* (2013.01)

(58) Field of Classification Search
CPC ..... F04C 29/026; F04C 2/16; F04C 2240/20; F04C 2240/30; F04C 2240/50; F04C 2240/52; F04C 2270/18; F04C 2280/04
USPC ..... 418/84
See application file for complete search history.

(56) References Cited

U.S. PATENT DOCUMENTS

| | | | | |
|---|---|---|---|---|
| 2007/0163840 | A1 | 7/2007 | Sekiya et al. | |
| 2011/0076174 | A1* | 3/2011 | Kakiuchi | F04C 27/009 418/99 |
| 2015/0086343 | A1* | 3/2015 | Rizzo | F16J 15/44 415/173.5 |
| 2015/0260187 | A1* | 9/2015 | Endo | F04C 27/009 418/84 |
| 2018/0023571 | A1 | 1/2018 | Endo | |

* cited by examiner

COMPRESSION DEVICE

BACKGROUND OF THE INVENTION

1. Field of the Invention

The present invention relates to a compression device.

2. Background Art

Conventionally, oil-cooled screw compressors in which the same oil is shared as the injection oil supplied to the screw rotors and the lubrication oil for screw rotor bearings are known. There are cases in which, in a screw compressor, contaminated gas containing a component causing metal corrosion is compressed. In such a case, the corrosion component in the compressed gas dissolves into the lubrication oil via the injection oil, and bearing lifetime decreases due to the corrosion component. Further, there are also cases in which the viscosity of the lubrication oil decreases due to the compressed gas itself dissolving into the lubrication oil. In such cases, bearing lifetime decreases due to deterioration of bearing lubricity. Compression devices provided with measures for solving problems such as those described above are disclosed in JP 2009-299584 A, WO 2006/013636 A, and JP S52-4148001.

In the compression devices disclosed in JP 2009-299584 A, WO 2006/013636 A, and JP S52-41480U1, a supply system for the injection oil and a supply system for supplying the lubrication oil to the bearings are provided independent of one another. Due to this, the dissolution of the corrosion component and the compressed gas itself into the lubrication oil is suppressed in each of the injection oil and lubrication oil supply systems.

Further, JP 2009-299584 A discloses a structure in which a mechanical seal is provided between a bearing and a compression chamber in which rotors are housed, and sealing is provided between the compression chamber and the bearing by supplying a part of the lubrication oil supplied to the bearing to the mechanical seal. Further, JP 2009-299584 A also discloses a structure in which a carbon ring seal is provided between the bearing and the compression chamber, and sealing is provided between the compression chamber and the bearing by supplying a part of the compressed gas discharged from the compression chamber to the carbon ring seal. In these structures, the leakage of the compressed gas from the compression chamber to the bearing side is reduced inside the compressor, and as a result, the dissolution of the corrosion component and the compressed gas itself into the lubrication oil is reduced.

Further, WO 2006/013636 A discloses a structure in which sealing is provided between a compression chamber and a bearing by using a sealing device provided between the compression chamber and the bearing. With this structure as well, the leakage of the compressed gas from the compression chamber to the bearing side is reduced inside the compressor, and the dissolution of the corrosion component and the compressed gas itself into the lubrication oil is reduced.

In recent years, there are cases in which compression devices are applied to high-pressure use for compressing gas to a higher pressure than conventionally done, and a technique for preventing the leakage of high-pressure compressed gas to the bearing side is necessary.

In JP 2009-299584 A, sealing is provided between the compression chamber and the bearing by using the mechanical seal, to which the lubrication oil is supplied, or the carbon ring seal, to which the compressed gas is supplied. With such sealing structures, however, it is difficult to stop the leakage of compressed gas from the compression chamber to the bearing side in the case of high-pressure use.

Also in WO 2006/013636 A, in the case of high-pressure use, complete sealing between the compression chamber and the bearing cannot be provided by using the sealing device, and there is a risk of the compressed gas leaking from the compression chamber to the bearing side.

Further, in JP S52-41480U1 a structure for providing sealing between a compression chamber and a bearing is not provided, and thus the leakage of compressed gas from the compression chamber to the bearing side cannot be prevented.

Accordingly, in high-pressure use, there is a risk of compressor performance decreasing due to the compressed gas leaking from the compression chamber and also of bearing lifetime decreasing due to a corrosion component included in the compressed gas and the compressed gas itself dissolving into lubrication oil for the bearing, in each of JP 2009-299584 A, WO 2006/013636 A, and JP S52-41480U1.

SUMMARY OF THE INVENTION

It is an object of the invention to provide a compression device which is free from the problems residing in the prior art.

It is another object of the invention to provide a compression device which can prevent a decrease in compressor performance in high-pressure use and can prevent a decrease in bearing lifetime in high-pressure use.

According to an aspect of the invention, a compression device includes: a compressor including a casing having a rotor chamber, a rotor that is housed in the rotor chamber inside the casing and configured to compress gas by rotating, a rotor shaft that extends from the rotor, a bearing that is provided inside the casing and supports the rotor shaft so that the rotor is rotatable, and a first shaft-sealing part and a second shaft-sealing part that are provided to line up between the rotor chamber and the bearing in the casing to seal a periphery of the rotor shaft; a first supply line that is adapted to supply injection oil to the rotor chamber; a second supply line that is provided independent of the first supply line and adapted to supply lubrication oil to the bearing; a third supply line that is adapted to supply sealing gas to the first shaft-sealing part; and a fourth supply line that is adapted to supply the second shaft-sealing part with sealing oil to be used for sealing at the second shaft-sealing part.

DETAILED DESCRIPTION OF EMBODIMENTS OF THE INVENTION

In the following, embodiments according to the present invention will be described with reference to the drawings.

First Embodiment

Figure 1:
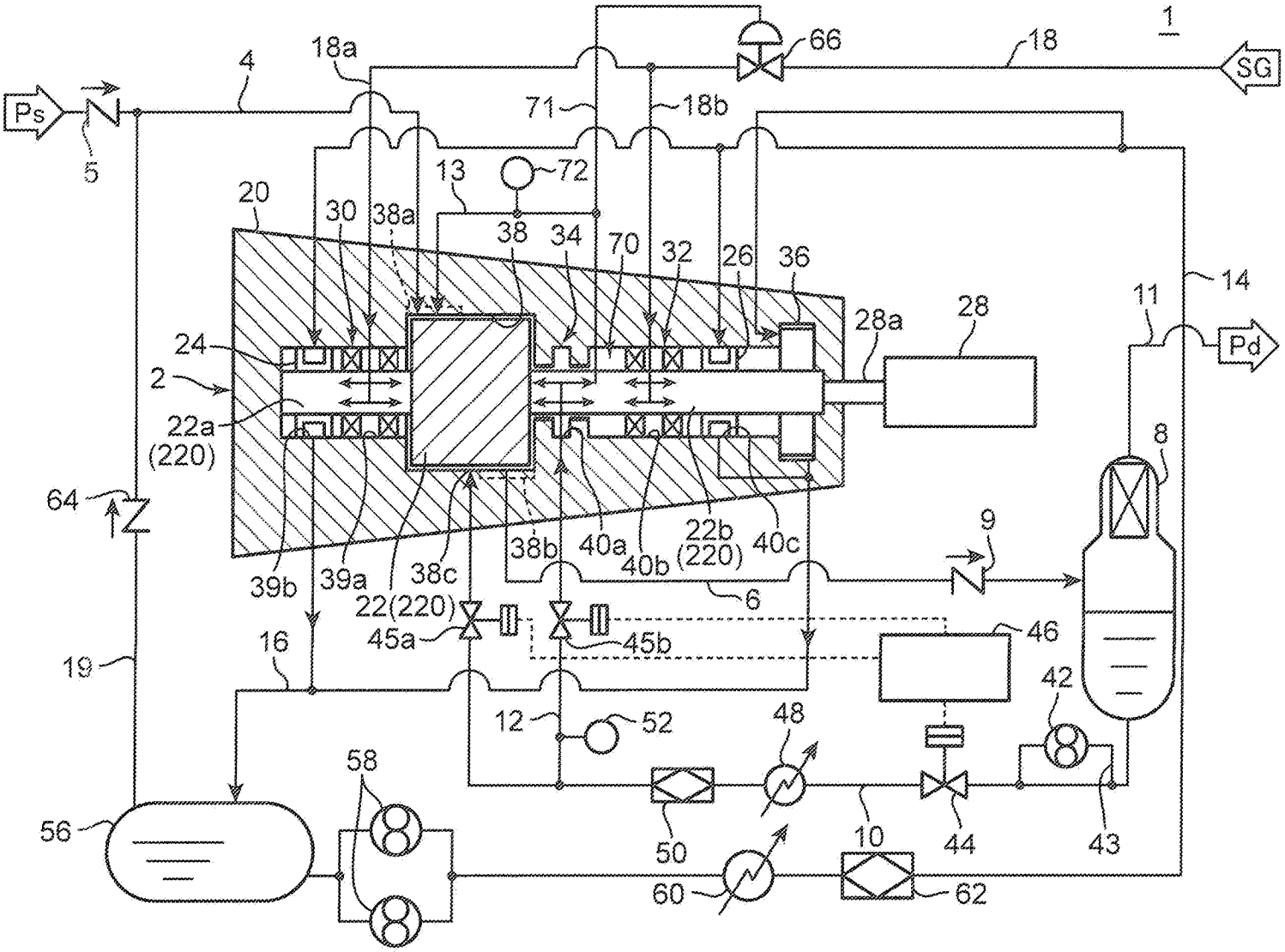
FIG. 1 is a system diagram of a compression device according to a first embodiment of the present invention.

FIG. 1 illustrates the configuration of a compression device 1 according to a first embodiment of the present invention. The compression device 1 according to the first embodiment includes: a compressor 2; an intake line 4; a discharge line 6; a separator 8; a driving machine 28; and a controller 46. The compression device 1 further includes: a first supply line 10 in which injection oil flows; a second supply line 14 in which lubrication oil flows; a third supply line 18 in which sealing gas flows; and a fourth supply line 12 branching off from the first supply line 10.

The compressor 2 is a screw compressor. Various types of gases are applicable as the compression-target gas. For example, the compression-target gas may be gases generated in petrochemical and various chemical processes and various exhaust gases, and the like, and may be contaminated gas containing a component causing metal corrosion.

The intake line 4 is connected to an intake port 38*a* of the compressor 2. A check valve 5 that prevents gas backflow is provided to the intake line 4. The discharge line 6 is connected to a discharge port 38*b* of the compressor 2.

In the compression device 1, the compressor 2 is driven by the driving machine 28, whereby gas is taken into the compressor 2 from the intake line 4. The gas taken in is compressed by the rotation of rotor parts 220, and the compressed gas is discharged onto the discharge line 6. The injection oil introduced into a rotor chamber 38 is contained in the compressed gas.

The separator 8 is connected to the downstream-side end part of the discharge line 6. The compressed gas containing oil is introduced into the separator 8 from the discharge line 6. In the separator 8, the oil is separated from the compressed gas having been introduced. The oil thus separated accumulates at the lower part inside the separator 8. Note that a check valve 9 is provided to the discharge line 6. Due to this check valve 9, the backflow of the compressed gas from the separator 8 to the compressor 2-side is prevented.

A gas discharge line 11 is connected to the upper part of the separator 8. The compressed gas after the oil has been separated inside the separator 8 is discharged through the gas discharge line 11.

The compressor 2 has: a casing 20; a pair of the rotor parts 220; a first bearing 24; a second bearing 26; a first gas seal 30; a second gas seal 32; an oil seal 34; and a balance piston 36.

The casing 20 includes: the rotor chamber 38; a first gas seal chamber 39*a*; a first bearing chamber 39*b*; an oil seal chamber 40*a*; a second gas seal chamber 40*b*; and a second bearing chamber 40*c*. The rotor chamber 38, the first gas seal chamber 39*a*, the first bearing chamber 39*b*, the oil seal chamber 40*a*, the second gas seal chamber 40*b*, and the second bearing chamber 40*c* are in communication with one another.

The rotor chamber 38 is located substantially at the center of the casing 20. At the upper left part of the rotor chamber 38 in FIG. 1, the intake port 38*a* connecting to the intake line 4 is provided. At the lower right part of the rotor chamber 38 in FIG. 1, the discharge port 38*b* connecting to the discharge line 6 is provided. Near the center of the rotor chamber 38, an oil inlet port 38*c* is formed, the oil inlet port 38*c* being a port through which the injection oil is introduced. In the description provided in the following, the left side of the compressor 2 in FIG. 1 is referred to as an "intake side", and the right side of the compressor 2 in FIG. 1 is referred to as a "discharge side".

The first gas seal chamber 39*a* and the first bearing chamber 39*b* are located further toward the intake side than the rotor chamber 38 is. Moving away toward the intake side from the rotor chamber 38, the first gas seal chamber 39*a* and the first bearing chamber 39*b* line up in this order. The first gas seal 30 is disposed in the first gas seal chamber 39*a*. The first bearing 24 is disposed in the first bearing chamber 39*b*.

The oil seal chamber 40*a*, the second gas seal chamber 40*b*, and the second bearing chamber 40*c* are located further toward the discharge side than the rotor chamber 38 is, in the casing 20. Moving away toward the discharge side from the rotor chamber 38, the oil seal chamber 40*a*, the second gas seal chamber 40*b*, and the second bearing chamber 40*c* line up in this order. That is, the oil seal chamber 40*a* is located between the rotor chamber 38 and the second gas seal chamber 40*b* in the compressor 2. The oil seal 34 is disposed in the oil seal chamber 40*a*. The second gas seal 32 is disposed in the second gas seal chamber 40*b*. The second bearing 26 is disposed in the second bearing chamber 40*c*. A return line 13 connecting to the intake port 38*a* of the rotor chamber 38 is connected to the space (referred to in the following as an "intermediate part 70") between the oil seal chamber 40*a* and the second gas seal chamber 40*b*. A pressure sensor 72 is installed onto the return line 13. The pressure in the return line 13 is detected by the pressure sensor 72. The pressure in the return line 13 corresponds to the pressure in the intermediate part 70, and thus, the pressure sensor 72 consequently detects the pressure in the intermediate part 70 in an indirect manner.

Each of the rotor parts 220 includes: a rotor 22, which is a screw; a first rotor shaft 22*a*; and a second rotor shaft 22*b*. In FIG. 1, only one of the rotor parts 220 is illustrated. However, the other rotor part 220 is actually disposed at the far side of the drawing sheet of FIG. 1 in the direction perpendicular to the drawing sheet. The rotor 22, the first rotor shaft 22*a*, and the second rotor shaft 22*b* are integrally formed. The rotor 22 is housed inside the rotor chamber 38. In the tooth space between the pair of rotors 22, a compression space into which the compression-target gas is introduced is formed.

The first rotor shaft 22*a* extends from the intake-side end surface of the rotor 22 and is inserted into the first gas seal chamber 39*a* and the first bearing chamber 39*b*. The second rotor shaft 22*b* extends from the discharge-side end surface of the rotor 22 and is inserted into the oil seal chamber 40*a*, the second gas seal chamber 40*b*, and the second bearing chamber 40*c*. The balance piston 36 is formed at the tip part of the second rotor shaft 22*b*. The thrust force generated during drive of the compressor 2 is reduced by the balance piston 36. The second rotor shaft 22*b* is connected to a drive shaft 28*a* of the driving machine 28, via a power transmission part illustration of which is not provided in the drawings. In the compressor 2, the first rotor shaft 22*a* and the second rotor shaft 22*b* are supported so as to be rotatable about the axes thereof by the first bearing 24 and the second bearing 26, respectively.

One end of the first supply line 10 is connected to the lower part of the separator 8. The other end of the first supply line 10 is connected to the oil inlet port 38*c* of the rotor chamber 38. The first supply line 10 supplies the oil having been separated at the separator 8 to the rotor chamber 38 through the oil inlet port 38*c* as the injection oil. The injection oil is used in the rotor chamber 38 to seal the compression space and to cool the compressed gas. In the compression device 1, a circulation system (referred to in the following as a "first oil system") in which the injection oil circulates between the rotor chamber 38 and the separator 8 is formed by the first supply line 10 and the discharge line 6. Due to the first oil system being formed, it becomes unnecessary to supply the injection oil to the rotor chamber 38 from an external supply source.

A pump 42, a first opening control valve 44, a second opening control valve 45*a*, a cooler 48, and an oil filter 50 are provided to the first supply line 10. The first opening control valve 44 is located further toward the upstream side than a branching point is, the branching point being a point of the first supply line 12 at which the fourth supply line 12 branches off from the first supply line 12. The opening of each of the first opening control valve 44 and the second opening control valve 45*a* is controlled by the controller 46. The pump 42 is connected to the first supply line 10 via a detour line 43, at a position that is further toward the upstream side than the position at which the fourth supply line 12 branches off from the first supply line 10 is. The cooler 48 cools the injection oil flowing in the first supply line 10. The oil filter 50 removes impurities in the injection oil flowing in the first supply line 10.

The pressure at the oil inlet port 38*c* of the rotor chamber 38 is around an intermediate level between the pressure of the compressed gas in the discharge line 6 and the gas pressure in the intake line 4. The injection oil inside the separator 8 has a pressure equal to the discharge pressure of the compressed gas, and due to pressure difference, is supplied to the inside of the rotor chamber 38 through the first supply line 10 from the oil inlet port 38*c*.

However, when the discharge pressure of the compressed gas has decreased, such as upon startup of the compressor 2, the pump 42 is activated and the injection oil is pressure-fed toward the rotor chamber 38 and the oil seal 34 by the pump 42. Due to this, the injection oil can be supplied to the rotor chamber 38 and the oil seal 34 with certainty, even when the discharge pressure of the compressed gas has decreased.

The second supply line 14 is connected to a tank 56 in which the lubrication oil is stored. Pumps 58, a cooler 60, and an oil filter 62 are provided on the second supply line 14. The pumps 58 send out the lubrication oil from the tank 56. The cooler 60 cools the lubrication oil flowing in the second supply line 14. The oil filter 62 removes impurities in the lubrication oil flowing in the second supply line 14. The lubrication oil inside the tank 56 is supplied through the second supply line 14 to the first bearing 24, the second bearing 26, and the balance piston 36.

The lubrication oil after lubrication of the first bearing 24, the second bearing 26, and the balance piston 36 is returned to the tank 56 through a lubrication oil discharge line 16, which is a part of the second supply line 14. Note that the compression device 1 is provided with a line 19 that connects the tank 56 with the intake line 4, and a check valve 64 is provided to the line 19. A part of the oil stored in the tank 56 is supplied to the intake line 4 through the line 19 or that is, through the check valve 64.

Hence, in the compression device 1, a circulation system (referred to in the following as a "second oil system") in which the lubrication oil circulates between the first and second bearings 24, 26 and the tank 56 is formed by the second supply line 14. The second oil system is independent of the first oil system. That is, the second supply line 14, which supplies the lubrication oil to the first and second bearings 24, 26, is provided independent of the first supply line 10, which supplies the injection oil to the rotor chamber 38. Due to this, the mixing of components contained in the compressed gas into the lubrication oil in the second oil system can be prevented. Consequently, a decrease in lifetime of the second bearing 26 can be prevented.

The third supply line 18 is adapted to supply the sealing gas to the first gas seal 30 and the second gas seal 32. In the present embodiment, the sealing gas is a gas of a different type from the compression-target gas, and is supplied from the outside. For example, as the sealing gas, an inert gas such as nitrogen gas, or various types of gases that do not affect the compressed gas even when mixing into the compressed gas are used.

A differential pressure-type pressure control valve 66, an intake-side line 18*a* and a discharge-side line 18*b* are provided to the third supply line 18, the pressure control valve 66 being configured to control the pressure of the sealing gas, both the intake-side line 18*a* and the discharge-side line 18*b* being located at the downstream side of the pressure control valve 66. The sealing gas, after passing through the pressure control valve 66, is supplied to the first gas seal 30 through the intake-side line 18*a* and to the second gas seal 32 through the discharge-side line 18*b*. Due to this, the periphery of the first rotor shaft 22*a* is sealed at the first gas seal 30, and the leakage of gas from the intake-side end part of the rotor chamber 38 is prevented. Similarly, the periphery of the second rotor shaft 22*b* is sealed at the second gas seal 32.

A branch line 71 branching off from the return line 13 is connected to the pressure control valve 66. The pressure control valve 66 is provided with: a gas flow channel inside which the sealing gas flows; and a diaphragm that controls the opening of the gas flow channel. The diaphragm controls the opening of the gas flow channel in accordance with the pressure in the return line 13 (that is, the pressure in the intermediate part 70). For example, when the pressure in the return line 13 increases, the opening of the gas flow channel increases, whereby the pressure (or flow rate) of the sealing gas increases in the part that is located further toward the downstream-side than the pressure control valve 66 is. When the pressure in the return line 13 decreases, the opening of the gas flow channel decreases, whereby the pressure (or flow rate) of the sealing gas decreases. Due to the pressure control valve 66 controlling the pressure of the sealing gas in accordance with the change in pressure in the return line 13, a state in which the pressure of the sealing gas is higher than the pressure in the return line 13 (and in the intermediate part 70) is maintained. Consequently, the sealing gas can be supplied to the first and second gas seals 30, 32 with certainty. Note that the pressure around the first gas seal 30 is at a similar level as the pressure in the intermediate part 70, and thus, it suffices for the opening of the pressure control valve 66 to be controllable in accordance with the pressure in the intermediate part 70. In the compression device 1, the pressure control valve 66 can easily control the pressure of the sealing gas by using the pressure in the return line 13 (that is, the pressure in the intermediate part 70).

The fourth supply line 12 branches off from a position of the first supply line 10 between the pump 42 and the rotor chamber 38, and connects to the oil seal 34. The discharge pressure of the compressed gas is higher than the pressure inside the oil seal 34, and thus the injection oil, the pressure of which is equal to the discharge pressure of the compressed gas, is supplied to the oil seal 34 through the fourth supply line 12. At the oil seal 34, the injection oil functions as a sealing oil that seals the periphery of the second rotor shaft 22*b*.

A third opening control valve 45*b* and a pressure sensor 52 are provided to the fourth supply line 12. The pressure sensor 52 is located further toward the upstream side than the third opening control valve 45*b* is. The pressure sensor 52 detects the pressure of the injection oil in the part of each of the first supply line 10 and the fourth supply line 12, the part being located further toward the upstream side than the third opening control valve 45*b* is. The pressure sensor 52 outputs, to the controller 46, a signal indicating the detected pressure. The third opening control valve 45*b* is controlled by the controller 46.

Figure 2:
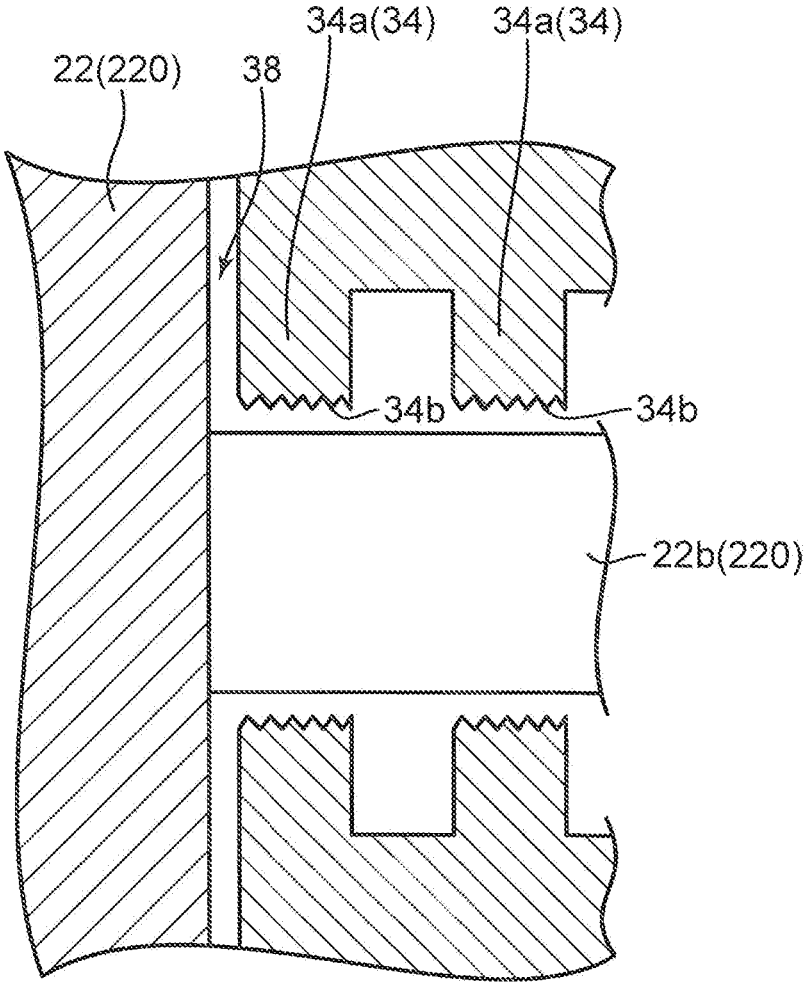
FIG. 2 is an enlarged view providing a partial illustration of the structure near an oil seal in a compressor illustrated in FIG. 1.

FIG. 2 is an enlarged view providing a partial illustration of the structure near the oil seal 34 in FIG. 1. In the following, the direction in which the rotor parts 220 extend is referred to as an "axial direction". As illustrated in FIG. 2, the oil seal 34 has two labyrinth seals 34*a* that line up spaced away in the axial direction of the second rotor shaft 22*b*. Each of the labyrinth seals 34*a* protrudes toward the inside from the inner peripheral surface of the casing 20 and encircles the periphery of the second rotor shaft 22*b*. The inner peripheral surface of each of the labyrinth seals 34*a* faces the outer peripheral surface of the second rotor shaft 22*b* with a minute gap formed therebetween. A thread groove 34*b* is formed in the inner peripheral surface of the each of the labyrinth seals 34*a*.

The space between the oil seal 34 and the second rotor shaft 22*b* is filled by the injection oil supplied from the fourth supply line 12. The pressure of the injection oil is higher than the pressure at the rotor 22-side end part of the second rotor shaft 22*b*, and thus, the flow of the compressed gas from the rotor chamber 38 to the second rotor shaft 22*b* is restricted. The rotor 22-side end part of the second rotor shaft 22*b* is one end part which is closer to the rotor 22 than the other end part among the both end parts of the second rotor shaft 22*b*. The pressure at the rotor 22-side end part of the second rotor shaft 22*b* is referred to in the following as a "rotor end part pressure". Further, the thread grooves 34*b* have helical shapes for sending oil from the labyrinth seals 34*a* to the rotor chamber 38-side as the second rotor shaft 22*b* rotates, and thus, force toward the rotor chamber 38 acts on the injection oil due to the relative rotation between the thread grooves 34*b* and the second rotor shaft 22*b*. Due to this, the flow of compressed gas from the rotor chamber 38 toward the second rotor shaft 22*b* can be restricted with more certainty.

In the compressor 2 illustrated in FIG. 1, the injection oil discharged from the oil seal 34 flows into the intermediate part 70 and is supplied to the intake port 38*a* through the return line 13. Due to this, the injection oil having been used in the oil seal 34 can be reused for cooling inside the rotor chamber 38, the lubrication of the rotors 22, and the like. Further, a part of the high pressure sealing gas supplied to the second gas seal 32 also flows into the intermediate part 70 and is supplied to the intake port 38*a* through the return line 13.

In the compressor 2, the flow of the sealing gas into the oil seal chamber 40*a* and the flow of the injection oil into the second gas seal chamber 40*b* are prevented due to the intermediate part 70 being connected to the intake port 38*a* via the return line 13. Consequently, a situation in which the shaft-sealing performance of the oil seal 34 and the shaft-sealing performance of the second gas seal 32, unfortunately, are mutually impeded can be prevented.

Next, description is provided of the control of the opening of the first, second, and third opening control valves 44, 45*a*, 45*b* by the controller 46 during drive of the compressor 2.

The controller 46 controls the opening of the first opening control valve 44 so that the pressure detected by the pressure sensor 52 equals a predetermined value. The predetermined value is set to a value that is at least higher than the rotor end part pressure of the second rotor shaft 22*b* and the pressure at the oil inlet port 38*c* of the rotor chamber 38. Due to this, the pressure (or flow rate) of the injection oil at the part of the first supply line 10 that is located further toward the upstream side than the second opening control valve 45*a* and the third opening control valve 45*b* are is set.

Next, the opening of the second opening control valve 45*a* is controlled based on the temperature detected by a temperature sensor (not shown in the drawings) provided to the discharge line 6, or more precisely, provided on a part of the discharge line 6 that is located further toward the upstream side than the check valve 9 is. Due to this, the temperature of the compressed gas is always maintained at a predetermined value or lower, even when the discharge pressure of the compressed gas fluctuates.

Further, the opening of the third opening control valve 45*b* is controlled so that the pressure of the injection oil supplied to the oil seal 34 is higher than the rotor end part pressure of the second rotor shaft 22*b* and the pressure detected by the pressure sensor 72. In other words, the opening of the third opening control valve 45*b* is controlled so that the pressure of the injection oil supplied to the oil seal 34 is higher than the pressure in the return line 13. Due to the third opening control valve 45*b* being provided, it can be ensured that the pressure of the injection oil at the oil seal 34 is always higher than the rotor end part pressure of the second rotor shaft 22*b* and the pressure in the return line 13, even when the rotor end part pressure of the second rotor shaft 22*b* and the pressure in the return line 13 fluctuate. In the present embodiment, the rotor end part pressure of the second rotor shaft 22*b* is acquired by a pressure sensor that communicates with a minute space (not shown in the drawings) formed in the casing 20. Note that the rotor end part pressure can be determined through calculation, based on the discharge pressure of the compressed gas. The same applies to the following embodiments.

In the compression device 1, the opening of the first opening control valve 44, the opening of the second opening control valve 45*a*, and the opening of the third opening control valve 45*b* need not be controlled sequentially, and may be controlled independent of one another. The same applies to the following embodiments. Note that the controller 46 sets the opening of the first opening control valve 44 to zero when the operation of the compressor 2 stops, that is, when the operation of the driving machine 28 stops. Due to this, the backflow of the compressed gas and the injection oil inside the separator 8 can be prevented.

Up to this point, description has been provided of the structure of the compression device 1 according to the first embodiment. In the compressor 2 of the compression device 1, the second gas seal 32, which is a first shaft-sealing part that seals the periphery of the second rotor shaft 22*b*, and the oil seal 34, which is a second shaft-sealing part that seals the periphery of the second rotor shaft 22*b*, are provided to line up between the rotor chamber 38 and the second bearing 26 located at the discharge side. Due to this, the sealing between the rotor chamber 38 and the second bearing 26 can be enhanced even when the pressure of the compressed gas becomes high. Consequently, a decrease in performance of the compressor 2 can be prevented. Further, the injection oil can be supplied to the oil seal 34 with certainty by the controller 46 controlling the opening of the first and third opening control valves 44, 45*b*.

In the compression device 1, a part of the injection oil flowing in the first supply line 10 is used as the sealing oil of the oil seal 34, and thus complication of oil flow channels formed around the compressor 2 can be prevented. Due to the second gas seal 32 being provided further toward the discharge side than the oil seal 34 is, the injection oil supplied to the oil seal 34 can be prevented from flowing into the second bearing 26.

In the compression device 1, a control unit controlling the opening of the first opening control valve 44, a control unit controlling the opening of the second opening control valve 45*a*, and a control unit controlling the opening of the third opening control valve 45*b* are configured inside one controller 46, but these control units may be configured by using a plurality of controllers.

Second Embodiment

Figure 3:
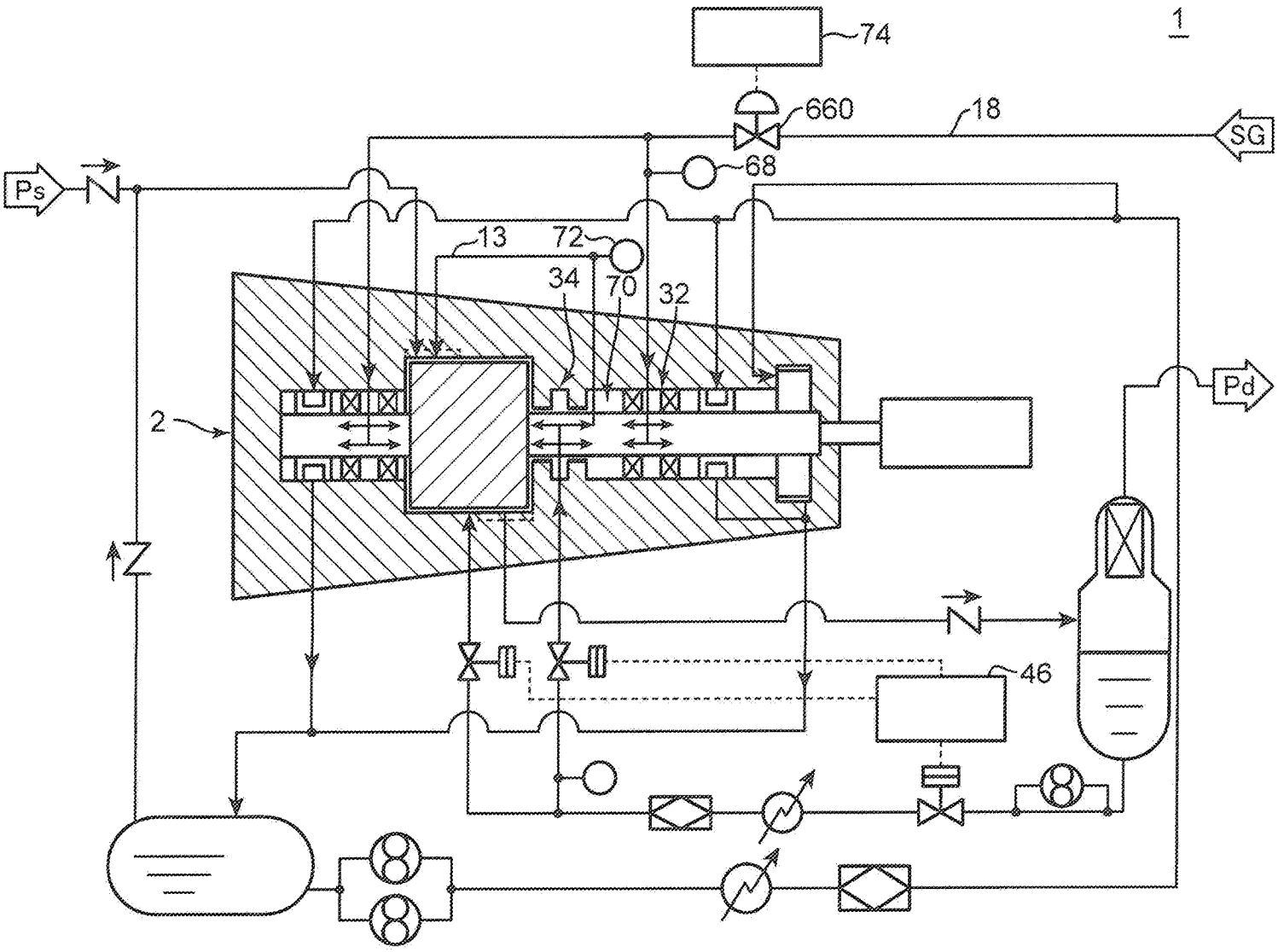
FIG. 3 is a system diagram of a compression device according to a second embodiment of the present invention.

FIG. 3 illustrates a system diagram of a compression device 1 according to a second embodiment of the present invention. With reference to FIG. 3, description is provided of the compression device 1 according to the second embodiment.

A pressure control valve 660 that is an electromagnetic valve and a pressure sensor 68 that detects the pressure of the sealing gas are provided to the third supply line 18. The branch line 71 of the return line 13 is omitted. The detection values of the pressor sensors 68, 72 are input to a controller 74. Other configurations of the compression device 1 according to the second embodiment are similar to those in the first embodiment.

At the controller 74, the opening of the pressure control valve 660 is controlled so that the pressure detected by the pressure sensor 68 is higher than the pressure detected by the pressure sensor 72, that is, the pressure in the return line 13. Due to this, it can be ensured that the pressure of the sealing gas is higher than the pressure in the intermediate part 70 (that is, the pressure between the second gas seal 32 and the oil seal 34), and consequently, the sealing gas can be supplied to the second gas seal 32 with certainty.

In the second embodiment, the controller 74 may be omitted and a control unit that controls the opening of the pressure control valve 660 may be configured inside the controller 46.

Third Embodiment

Figure 4:
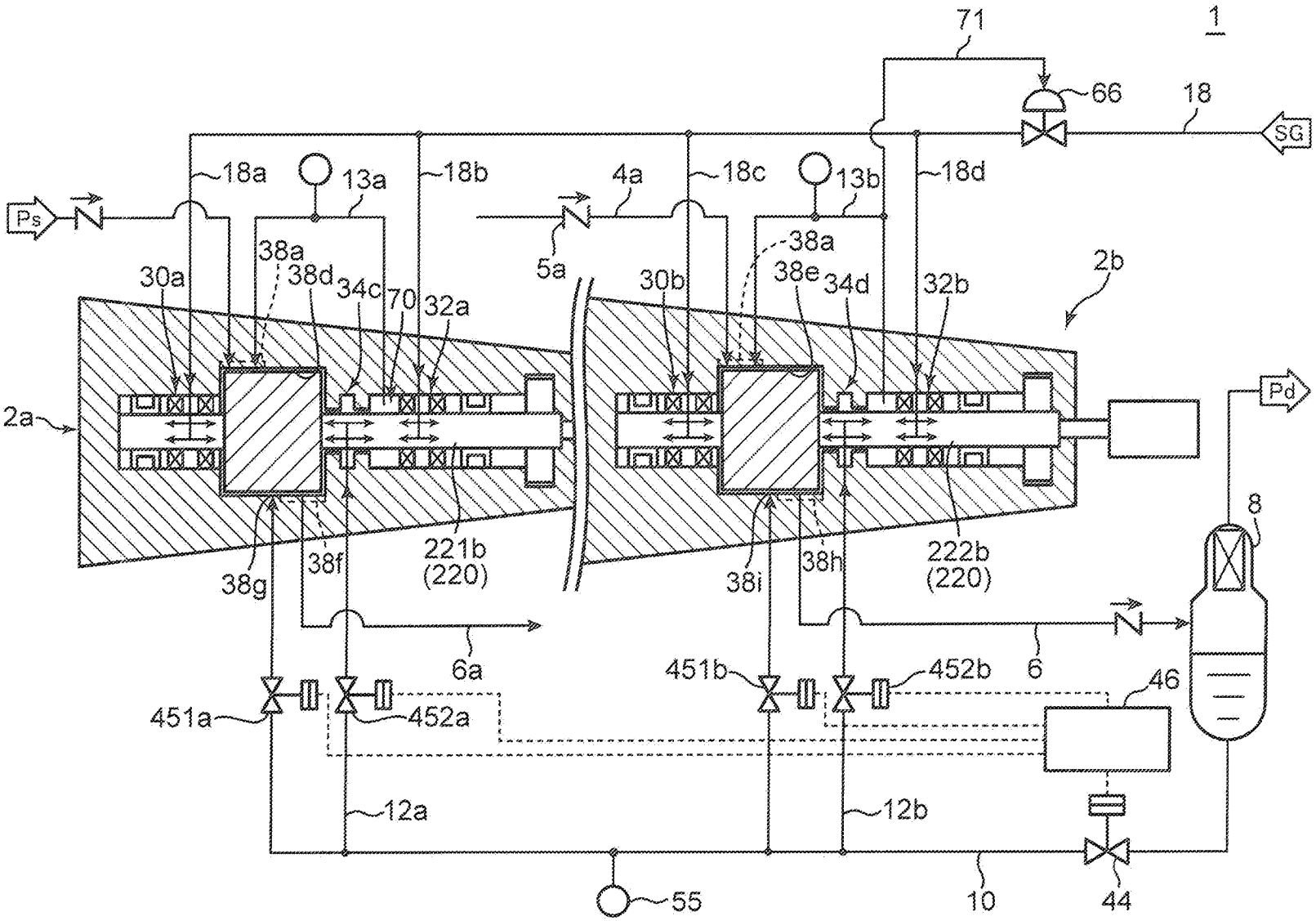
FIG. 4 is a system diagram of a compression device according to a third embodiment of the present invention.

FIG. 4 illustrates a system diagram of a compression device 1 according to a third embodiment of the present invention. Note that in FIG. 4, illustration of the second supply line and devices provided along the second supply line are omitted. The compression device 1 is a two-stage compression-type compression device. That is, the compression device 1 has: a low-pressure compressor 2*a* constituting the low-pressure stage; and a high-pressure compressor 2*b* constituting the high-pressure stage. The structure of each of the low-pressure compressor 2*a* and the high-pressure compressor 2*b* is substantially the same as that of the compressor 2 in FIG. 1.

The low-pressure compressor 2*a* is provided with a return line 13*a* that connects the intake port 38*a* with the intermediate part 70, which is between a second gas seal 32*a* and an oil seal 34*c* located further toward the discharge side than a rotor chamber 38*d* is. The high-pressure compressor 2*b* is provided with a return line 13*b* that connects the intake port 38*a* with the intermediate part 70, which is between a second gas seal 32*b* and an oil seal 34*d* located further toward the discharge side than a rotor chamber 38*e* is.

A discharge line 6*a* is connected to a discharge port 38*f* of the low-pressure compressor 2*a*. While not illustrated in FIG. 4, the discharge line 6*a* connects to an intake line 4*a* of the high-pressure compressor 2*b*. A check valve 5*a* is provided to the intake line 4*a*. The discharge line 6, which is connected to a discharge port 38*h* of the high-pressure compressor 2*b*, connects to the separator 8.

The separator 8 is connected, via the first supply line 10, to an oil inlet port 38*i* of the rotor chamber 38*e* of the high-pressure compressor 2*b* and an oil inlet port 38*g* of the rotor chamber 38*d* of the low-pressure compressor 2*a*. On the first supply line 10, the first opening control valve 44 is located further toward the upstream side than the position at which a fourth supply line 12*b* branches off from the first supply line 10. Further, on the first supply line 10, a second opening control valve 451*a* and a second opening control valve 451*b* are respectively provided near the oil inlet port 38*g* of the low-pressure compressor 2*a* and the oil inlet port 38*i* of the high-pressure compressor 2*b*.

In the compression device 1, the fourth supply line 12*b* and a fourth supply line 12*a*, which branch off from the first supply line 10, are respectively connected to the oil seal 34*d* of the high-pressure compressor 2*b* and the oil seal 34*c* of the low-pressure compressor 2*a*. The fourth supply line 12*a* and the fourth supply line 12*b* are respectively provided with a third opening control valve 452*a* and a third opening control valve 452*b*. The opening of each of the first opening control valve 44, the second opening control valves 451*a*, 451*b*, and the third opening control valves 452*a*, 452*b* is controlled by the controller 46.

The third supply line 18 includes the pressure control valve 66. Lines 18*a*, 18*b* are provided to the third supply line 18 at positions that are further toward the downstream side than the pressure control valve 66 is, and the line 18*a* and line 18*b* respectively connect to a first gas seal 30*a* and the second gas seal 32*a*, which are respectively provided at the intake side and the discharge side of the low-pressure compressor 2*a*. Further, lines 18*c*, 18*d* are provided to the third supply line 18, and the line 18*c* and line 18*d* respectively connect to a first gas seal 30*b* and the second gas seal 32*b*, which are respectively provided at the intake side and the discharge side of the high-pressure compressor 2*b*.

The branch line 71 of the return line 13*b* provided to the high-pressure compressor 2*b* is connected to the pressure control valve 66. Similarly to in the first embodiment, due to the pressure control valve 66, a state in which the pressure of the sealing gas is higher than the pressure in the return lines 13*a*, 13*b* (and in the intermediate parts 70) can be maintained, whereby the sealing gas can be supplied to each of the gas seals 30*a*, 30*b*, 32*a*, 32*b* with certainty even when the pressure in the return lines 13*a*, 13*b* (and in the intermediate parts 70) fluctuates.

During drive of the compression device 1, the controller 46 controls the opening of the first opening control valve 44 on the first supply line 10 so that the pressure detected by a pressure sensor 55 equals a predetermined value, the pressure sensor 55 being provided to the first supply line 10 to detect the pressure of the injection oil in the first supply line 10. The predetermined value is set to a value that is at least higher than the rotor end part pressure of a second rotor shaft 222*b* in the high-pressure compressor 2*b* and the pressure at the oil inlet port 38*i* of the rotor chamber 38*e*.

Next, the opening of the second opening control valve 451*b* is controlled based on the temperature detected by a temperature sensor (not shown in the drawings) provided to the discharge line 6 of the high-pressure compressor 2*b*. Due to this, the amount of the injection oil flowing into the oil inlet port 38*i* is controlled, and consequently, the temperature of the compressed gas is maintained at a predetermined value or lower even when the discharge pressure fluctuates. Further, the opening of the third opening control valve 452*b* is controlled so that the pressure of the injection oil supplied to the oil seal 34*d* is higher than the rotor end part pressure of the second rotor shaft 222*b* and the pressure in the return line 13*b*.

Similarly to for the high-pressure compressor 2*b*, the opening of the second opening control valve 451*a* is controlled based on the temperature detected by a temperature sensor (not shown in the drawings) provided to the discharge line 6*a* of the low-pressure compressor 2*a*, also for the low-pressure compressor 2*a*. Further, the opening of the third opening control valve 452*a* is controlled so that the pressure detected by the pressure sensor 55 is higher than the pressure in the return line 13*a* and the rotor end part pressure of a second rotor shaft 221*b*.

Also in the third embodiment, a second gas seal (32*a*, 32*b*), which is a first shaft-sealing part at the discharge side, and an oil seal (34*c*, 34*d*), which is a second shaft-sealing part, are provided between a rotor chamber (38*d*, 38*e*) and the second bearing 26 in both the high-pressure compressor 2*b* and the low-pressure compressor 2*a*, whereby the sealing between the rotor chamber (38*d*, 38*e*) and the second bearing 26 can be enhanced.

Similarly to the second embodiment in FIG. 3, the pressure control valve 660, which is an electromagnetic valve the opening of which can be controlled by the controller 74, may be used in place of the pressure control valve 66 in the third embodiment.

(First Modification)

Figure 5:
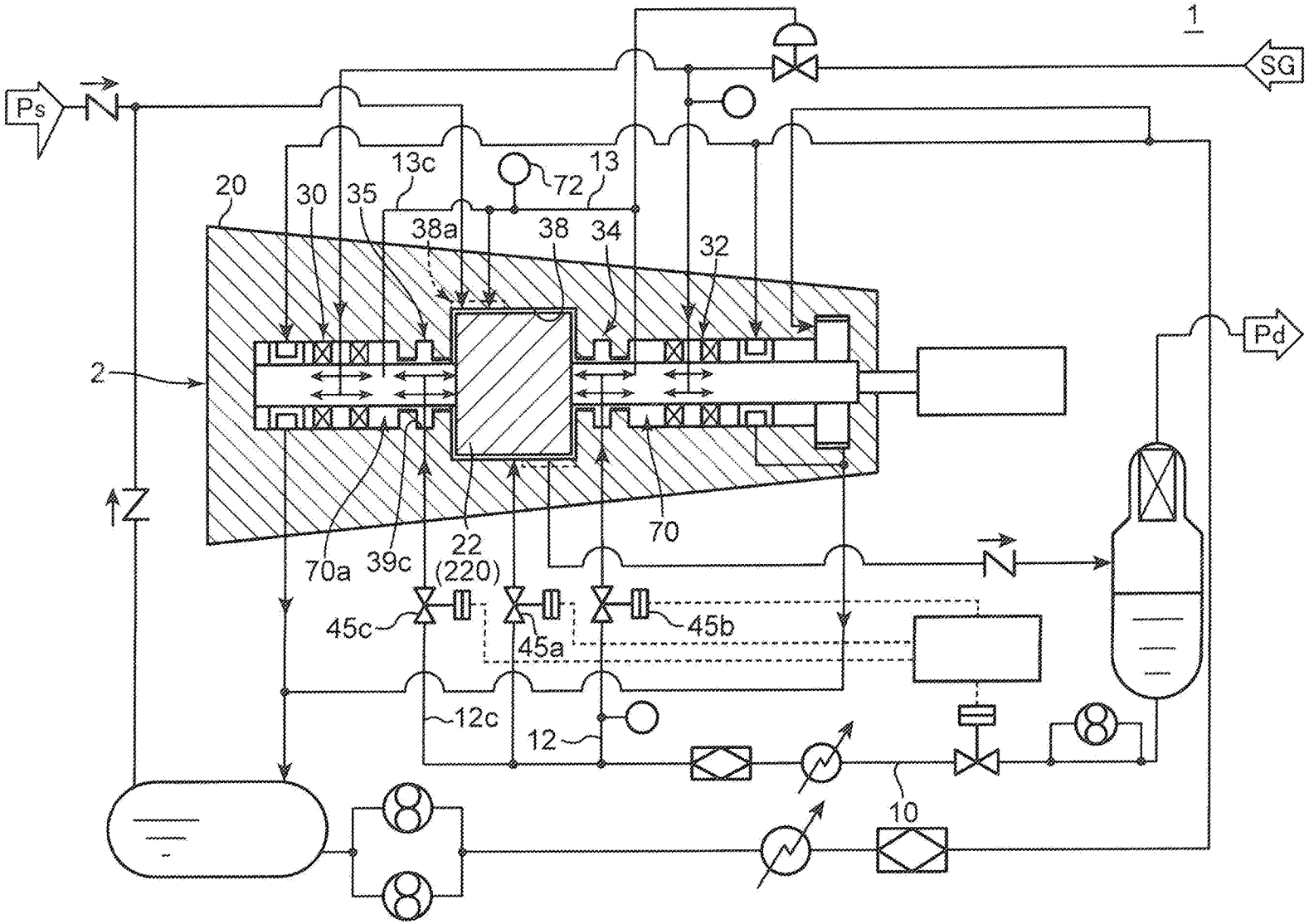
FIG. 5 is a system diagram of a compression device according to one modification of the first embodiment.

FIG. 5 is a diagram illustrating a modification of the compression device 1 according to the first embodiment. In this modification, a first oil seal 35 is provided further toward the intake side than the rotor chamber 38 is. In the following, in order to distinguish the oil seal 34 of the discharge side from the first oil seal 35, the oil seal 34 is referred to as a "second oil seal 34".

In the casing 20, a first oil seal chamber 39*c* in which the first oil seal 35 is disposed is provided adjacent to the intake-side end surface of the rotor chamber 38. That is, the first oil seal chamber 39*c* is disposed between the first gas seal 30 and the rotor 22.

A fourth supply line 12*c* branching off from the first supply line 10 connects to the first oil seal 35. The injection oil is supplied from the fourth supply line 12*c* to the first oil seal 35 as the sealing oil. A return line 13*c* connecting to the intake port 38*a* of the rotor chamber 38 is connected to an intermediate part 70*a* which is a space between the first oil seal chamber 39*c* and the first gas seal 30.

In the modification illustrated in FIG. 5, the first gas seal 30, which is a first shaft-sealing part, and the first oil seal 35, which is a second shaft-sealing part, are provided at the intake side of the rotor chamber 38, and the second gas seal 32, which is a first shaft-sealing part, and the second oil seal 34, which is a second shaft-sealing part, are provided at the discharge side of the rotor chamber 38. Due to this, leakage of the compression-target gas from the rotor chamber 38 is prevented with more certainty. The configuration of the modification illustrated in FIG. 5 can be applied to the compression devices 1 according to the other embodiments.

(Second Modification)

Figure 6:
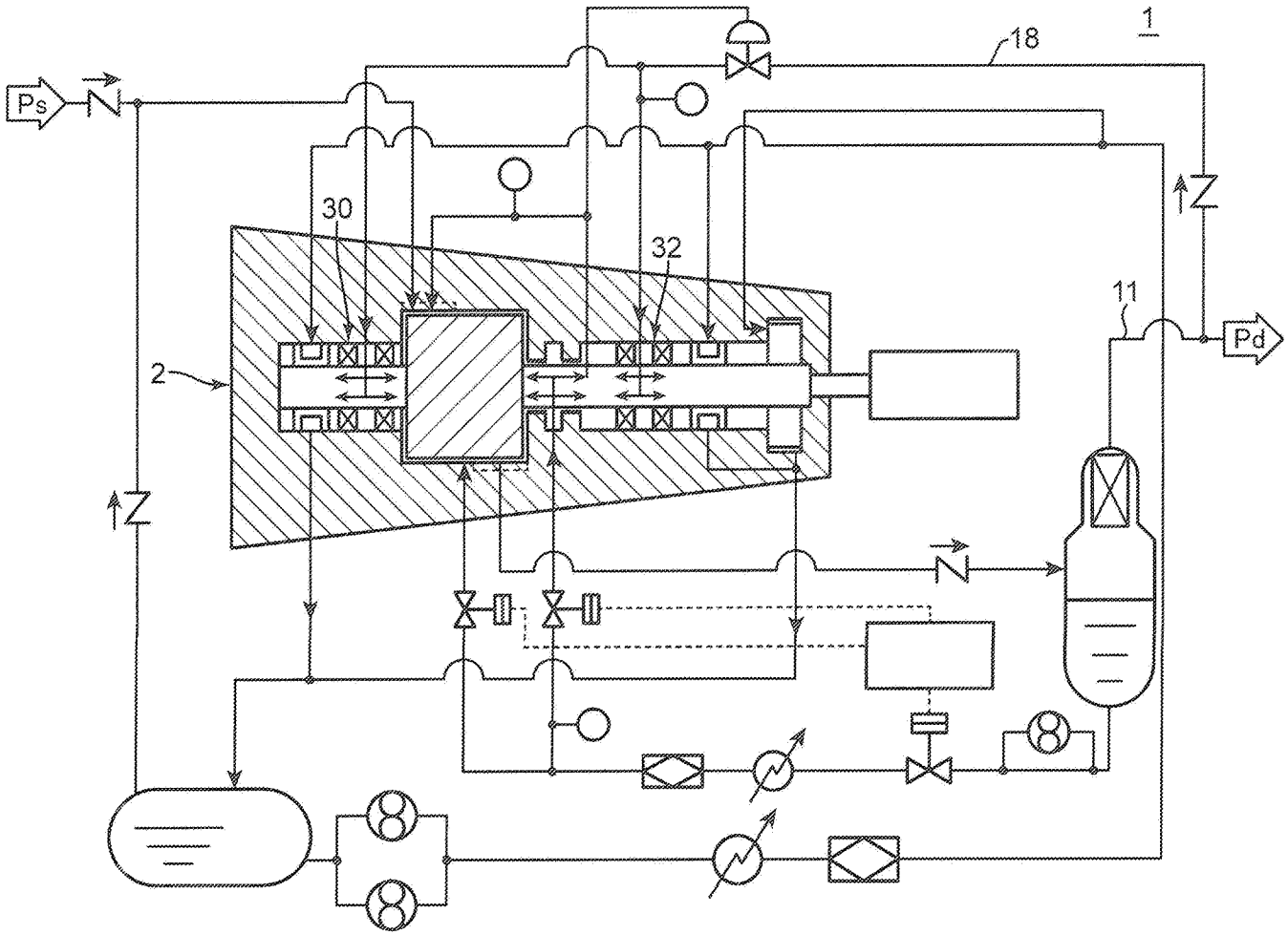
FIG. 6 is a system diagram of a compression device according to another modification of the first embodiment.

FIG. 6 is a diagram illustrating another modification of the compression device 1 according to the first embodiment. The third supply line 18 is connected to the gas discharge line 11. Apart of the compressed gas is supplied, as the sealing gas, to the first gas seal 30 and the second gas seal 32. According to this modification, there is no need of separately preparing the sealing gas and thus cost can be reduced. The configuration in FIG. 6 may be applied to the compression devices 1 according to the other embodiments.

(Third Modification)

Figure 7:
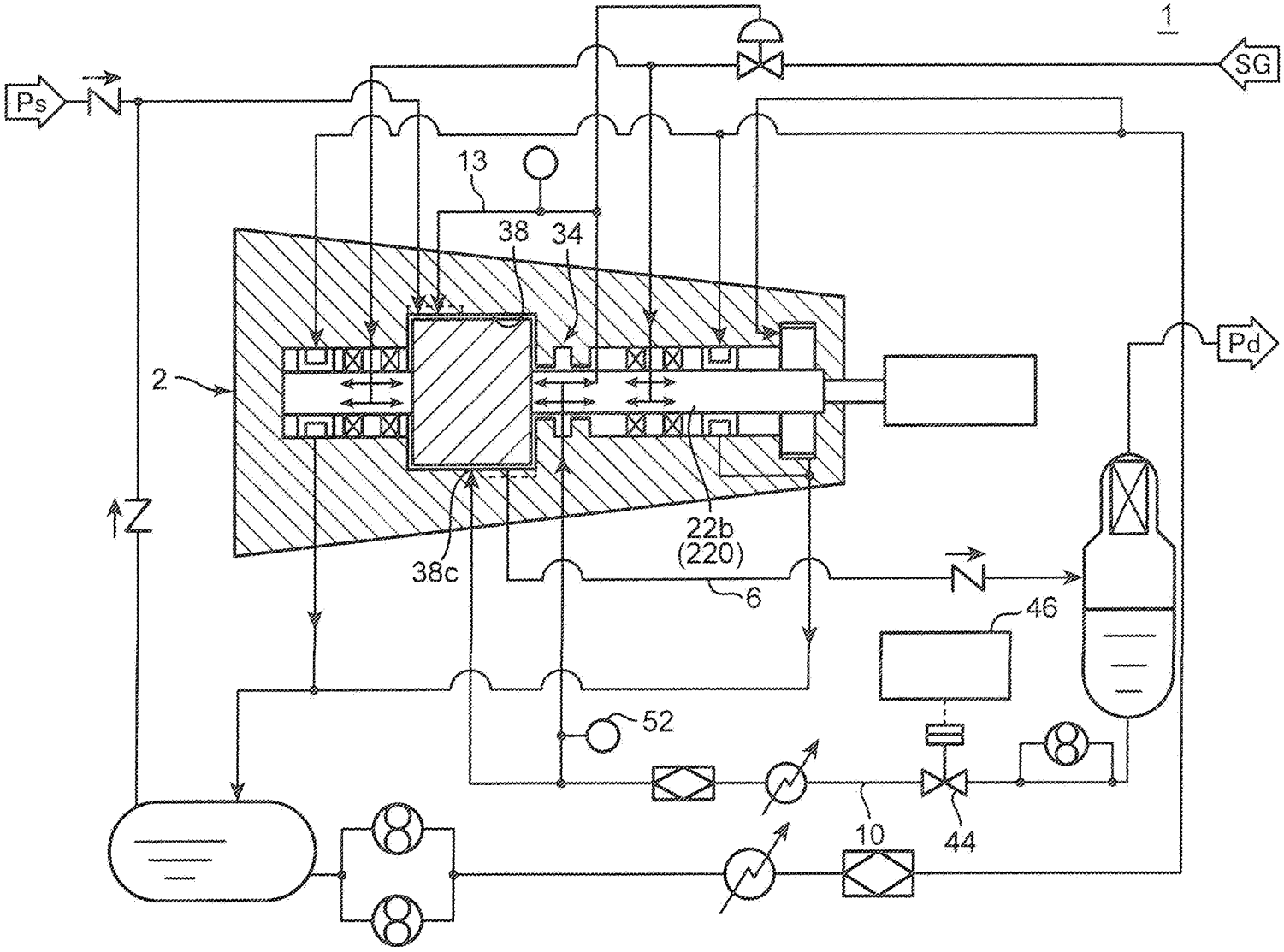
FIG. 7 is a system diagram of a compression device according to still another modification of the first embodiment.

FIG. 7 is a diagram illustrating still another modification of the compression device 1 according to the first embodiment. The second and third opening control valves 45*a*, 45*b* in FIG. 1 may be omitted when the temperature change of the compressed gas along the discharge line 6 and the fluctuation of pressure near the oil seal 34 are not excessively great. In this case, the controller 46 controls the opening of the first opening control valve 44 so that the pressure detected by the pressure sensor 52 provided to the fourth supply line 12 is greater than each of the pressure at the oil inlet port 38*c* of the rotor chamber 38; the rotor end part pressure of the second rotor shaft 22*b*; and the pressure in the return line 13. Due to this, the injection oil can be supplied to the rotor chamber 38 and the oil seal 34. Manufacturing cost can be reduced according to the compression device 1 in FIG. 7. The configuration in FIG. 7 may be applied to the compression devices 1 according to the other embodiments.

(Fourth Modification)

Figure 8:
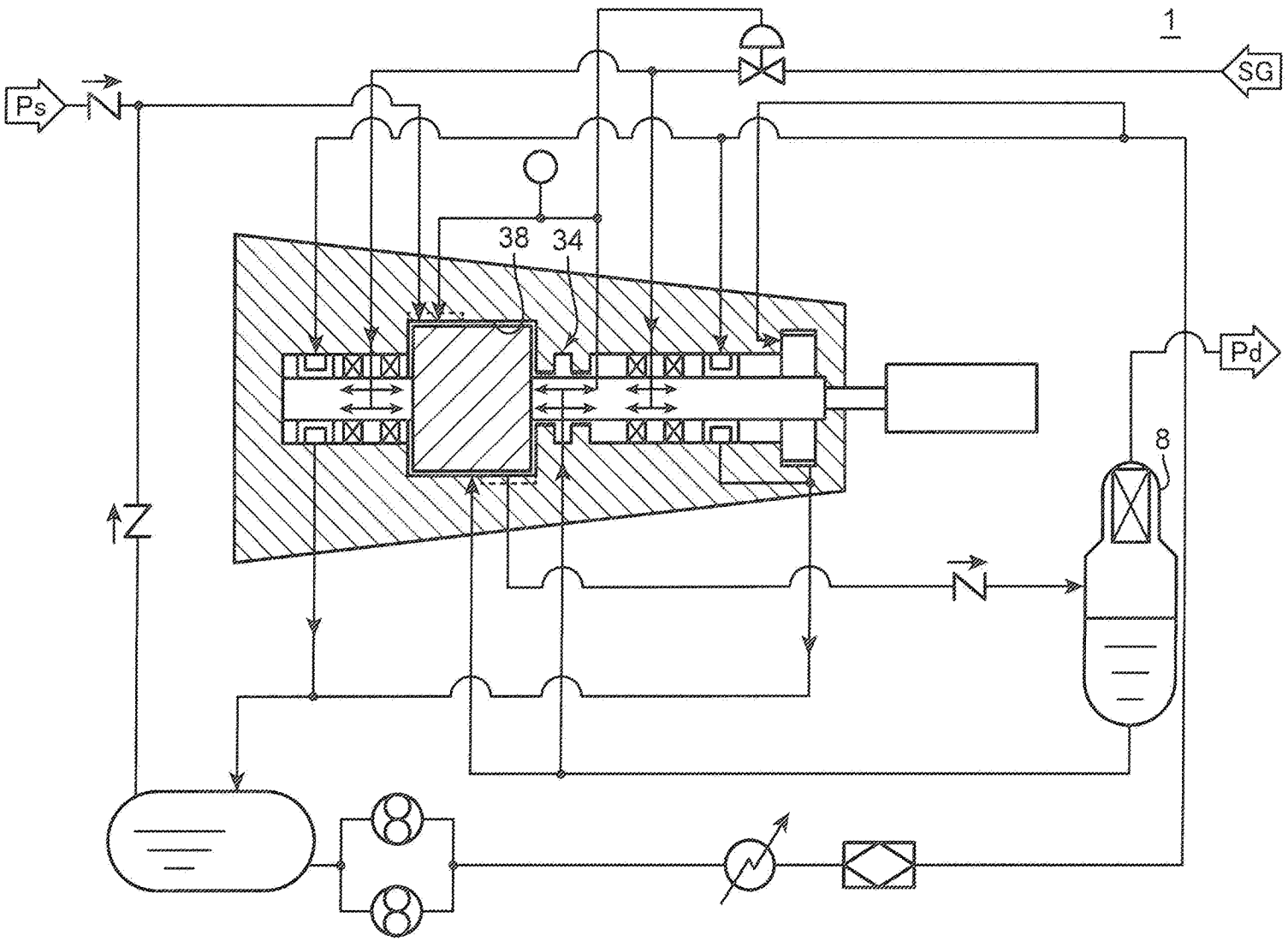
FIG. 8 is a system diagram of a compression device according to yet another modification of the first embodiment.

FIG. 8 is a diagram illustrating yet another modification of the compression device 1 according to the first embodiment. In this compression device 1, the first, second, and third opening control valves 44, 45*a*, 45*b*, and the pump 42, which are illustrated in FIG. 1, are omitted. That is, pressure control parts for controlling pressure are not provided between the separator 8 and the oil seal 34 and between the separator 8 and the rotor chamber 38. Due to this, the injection oil having been separated at the separator 8 is supplied to the rotor chamber 38 and the oil seal 34 in a state in which the pressure of the injection oil is maintained substantially constant. The state in which the pressure of the injection oil is maintained substantially constant refers to a state in which the pressure of the injection oil separated at the separator 8 is maintained constant, with the exception of pressure decrease due to flow channel resistance between the separator 8 and the oil seal 34 and pressure decrease due to flow channel resistance between the separator 8 and the rotor chamber 38. Manufacturing cost can be further reduced according to the configuration in FIG. 8 due to the devices of the compression device 1 being simplified. The configuration in FIG. 8 may be applied to the other embodiments.

The embodiments described herein are exemplary in every aspect, and should be construed as not being limiting. The scope of the present invention is indicated by the claims rather than the description of the embodiments provided above, and also includes all modifications within the meaning and range of equivalents of the claims.

For example, in the first embodiment, the return line 13 is connected to the intake port 38*a*. Due to this, the pressure in the return line 13 is always lower than the rotor end part pressure of the second rotor shaft 22*b*. Accordingly, the opening of the third opening control valve 45*b* may be controlled based on only the rotor end part pressure of the second rotor shaft 22*b*. In this case, the pressure sensor 72 of the return line 13 may be omitted. It is not always necessary for the return line 13 to be connected to the intake port 38*a*, as long as the return line 13 is connected to a space the pressure in which is lower than both the pressure at the oil seal 34 and the pressure at the second gas seal 32. For example, the return line 13 may be connected to the intake line 4. Further, the return line 13 may be formed inside the casing 20. The same also applies to the other embodiments.

In the above-described embodiments, sealing oil may be supplied to the oil seals 34, 34*c*, 34*d*, 35 from a supply source independent of the first oil system and the second oil system.

In the first embodiment, the second gas seal 32 may be provided between the rotor chamber 38 and the oil seal 34. In this case, the pressure of the sealing gas supplied to the second gas seal 32 would be made higher than the rotor end part pressure of the second rotor shaft 22*b* and the pressure in the intermediate part 70 between the second gas seal 32 and the oil seal 34. Further, the pressure of the injection oil supplied to the oil seal 34 would be made higher than the pressure in the intermediate part 70. A gas seal may be disposed further toward the rotor chamber 38-side than an oil seal is, also in the other embodiments.

In the above-described embodiments, the thread grooves provided to the labyrinth seals of the oil seals 34, 34*c*, 34*d*, 35 may be provided to the outer peripheral surface of the discharge-side rotor shaft facing the inner peripheral surfaces of the labyrinth seals. As labyrinth seals, those with shapes other than thread grooves (for example, parallel grooves) may be used.

In the first embodiment, an orifice may be provided to the first supply line 10 at a position that is further toward the downstream side than the branching point of the fourth supply line 12 is to control the flow rate to the oil inlet port 38*c*, in a case in which the flow rate of the injection oil supplied to the oil inlet port 38*c* is significantly greater than the flow rate of the injection oil supplied to the oil seal 34. The same also applies to the other embodiments.

In the compression devices 1 illustrated in FIG. 1 to FIG. 6, the first opening control valve 44 may be omitted and the pressure (or inflow) of the injection oil supplied to the rotor chamber 38 and the oil seal 34 may be controlled by the second and third opening control valves 45*a*, 45*b*.

In the above-described embodiments, the pressure sensor 52 may be provided to the first supply line 10. A pressure sensor directly detecting the pressure in the intermediate part 70 may be provided, in place of the pressure sensor 72. In the first and third embodiments, the branch line 71 may be omitted and a line directly connecting the intermediate part 70 and the pressure control valve 66 may be separately provided.

Overview of Embodiments and Modifications

The above-described embodiments and modifications can be summarized as follows.

A compression device according to the above-described embodiments and modifications includes: a compressor including a casing having a rotor chamber, a rotor that is housed in the rotor chamber inside the casing and configured to compress gas by rotating, a rotor shaft that extends from the rotor, a bearing that is provided inside the casing and supports the rotor shaft so that the rotor is rotatable, and a first shaft-sealing part and a second shaft-sealing part that are provided to line up between the rotor chamber and the bearing in the casing to seal a periphery of the rotor shaft; a first supply line that is adapted to supply injection oil to the rotor chamber; a second supply line that is provided independent of the first supply line and adapted to supply lubrication oil to the bearing; a third supply line that is adapted to supply sealing gas to the first shaft-sealing part; and a fourth supply line that is adapted to supply the second shaft-sealing part with sealing oil to be used for sealing at the second shaft-sealing part.

In this configuration, the second shaft-sealing part, to which the sealing oil is supplied, is provided between the rotor chamber and the bearing in addition to the first shaft-sealing part, to which the sealing gas is supplied, and thus, the sealing between the rotor chamber and the bearing can be enhanced. Due to this, in high-pressure use, the leakage of compressed gas from the rotor chamber to the bearing side can be prevented, and hence a decrease in compressor performance can be prevented. Further, due to the sealing between the rotor chamber and the bearing being enhanced, the dissolution of a corrosion component and the compressed gas itself into the lubrication oil inside the compressor can also be prevented.

In the compression device, it is preferable that the second shaft-sealing part is disposed between the first shaft-sealing part and the rotor in the casing.

According to this configuration, the flow of the sealing oil supplied to the second shaft-sealing part toward the bearing side can be suppressed by the sealing gas supplied to the first shaft-sealing part.

In the compression device, it is preferable that the fourth supply line branches off from the first supply line and connects to the second shaft-sealing part to supply a part of the injection oil flowing in the first supply line to the second shaft-sealing part as the sealing oil.

According to this configuration, the oil systems formed around the compressor can be simplified.

In the configuration in which the fourth supply line is adapted to supply a part of the injection oil flowing in the first supply line to the second shaft-sealing part as the sealing oil, it is preferable that the compression device further includes: a return line that is adapted to supply an intake side of the rotor chamber with the injection oil having been used for the sealing at the second shaft-sealing part.

According to this configuration, the injection oil having been used for sealing at the second shaft-sealing part can be supplied to the intake side of the rotor chamber through the return line and can be reused for lubrication of the rotor chamber, and the like.

It is preferable that the compression device further includes: a discharge line into which the compressed gas having been compressed by the rotor is discharged from the rotor chamber; and a separator that is connected to the discharge line to separate oil from the compressed gas, and in the compression device, the first supply line connects to the separator to supply the oil, which is having been separated at the separator, to the rotor chamber as the injection oil.

According to this configuration, the injection oil can be circulated between the rotor chamber and the separator, and hence the supply of injection oil to the rotor chamber from an external supply source becomes unnecessary.

In the compression device including the discharge line, it is preferable that the compressor is configured to discharge the compressed gas to the discharge line at a higher pressure than a pressure in the second shaft-sealing part.

According to this configuration, the oil having been separated at the separator can be supplied from the first supply line to the second shaft-sealing part through the fourth supply line by making use of the pressure difference between the discharge pressure of the compressed gas and the pressure in the second shaft-sealing part. Due to this, oil can be supplied to the second shaft-sealing part by using a simple configuration.

In the configuration in which the first supply line is adapted to supply the oil, which is having been separated at the separator, to the rotor chamber as the injection oil, and the fourth supply line is adapted to supply a part of the injection oil flowing in the first supply line to the second shaft-sealing part as the sealing oil, it is preferable that the compression device further includes: a pump that is connected to the first supply line to send the injection oil to the rotor chamber, and in the compression device, the fourth supply line branches off from the first supply line at a position of the first supply line between the pump and the rotor chamber.

According to this configuration, the injection oil can be supplied to the rotor chamber and the second shaft-sealing part with certainty, even when the discharge pressure of the compressed gas decreases, upon startup of the compressor, and the like, for example.

In the configuration in which the fourth supply line branches off from the first supply line and connects to the second shaft-sealing part, it is preferable that the compression device further includes: an opening control valve that is provided to the first supply line at a position that is located further toward an upstream side than a branching point of the fourth supply line is; and a control unit that controls an opening of the opening control valve so that a pressure of the injection oil in the first supply line is higher than a pressure at an oil inlet port of the rotor chamber and a rotor end part pressure, the oil inlet port being a port that is connected to the first supply line, the rotor end part pressure being a pressure at a rotor-side end part of the rotor shaft.

According to this configuration, the injection oil can be supplied to the second shaft-sealing part with certainty.

In the configuration in which the fourth supply line is adapted to supply a part of the injection oil flowing in the first supply line to the second shaft-sealing part as the sealing oil, it is preferable that the compression device further includes: another opening control valve provided on the fourth supply line; and another control unit that controls an opening of the other opening control valve so that a pressure of the injection oil supplied to the second shaft-sealing part is higher than a rotor end part pressure that is a pressure at a rotor-side end part of the rotor shaft.

According to this configuration, the injection oil can be supplied to the second shaft-sealing part with certainty.

It is preferable that the compression device, in which the first supply line is adapted to supply the oil, which is having been separated at the separator, to the rotor chamber as the injection oil and the fourth supply line is adapted to supply a part of the injection oil flowing in the first supply line to the second shaft-sealing part as the sealing oil, is configured so that the oil having been separated at the separator is supplied to the second shaft-sealing part in a state in which a pressure of the oil is maintained substantially constant.

According to this configuration, the structure of the compression device can be simplified.

In the compression device, it is preferable that the second shaft-sealing part has a labyrinth seal in which a thread groove is formed, and the thread groove has a helical shape for sending oil from the labyrinth seal to the rotor chamber-side as the rotor shaft rotates.

According to this configuration, it is possible to have force toward the rotor chamber act on the injection oil as the rotor shaft rotates, and hence the sealing of the second shaft-sealing part can be enhanced.

It is preferable that the compression device further includes: a pressure control valve that is provided to the third supply line to increase a pressure of the sealing gas supplied to the first shaft-sealing part to be higher than a pressure between the first shaft-sealing part and the second shaft-sealing part.

According to this configuration, the sealing gas can be supplied to the first shaft-sealing part with certainty.

In this case, it is preferable that the pressure control valve is a differential pressure-type control valve an opening of which is controlled by using the pressure between the first shaft-sealing part and the second shaft-sealing part.

According to this configuration, the pressure of the sealing gas can be controlled easily.

In this case, it is further preferable that the compression device further includes: a pressure sensor that detects the pressure of the sealing gas supplied from the third supply line to the first shaft-sealing part; another pressure sensor that directly or indirectly detects the pressure between the first shaft-sealing part and the second shaft-sealing part; and a control unit that performs control of causing the pressure control valve to control the pressure of the sealing gas based on the pressure detected by the pressure sensor and the pressure detected by the other pressure sensor.

According to this configuration, the sealing gas can be supplied to the first shaft-sealing part with certainty.

Hence, according to the above-described embodiments and modifications, a decrease in compressor performance in high-pressure use can be prevented, and also a decrease in bearing lifetime in high-pressure use can be prevented.

This application is based on Japanese Patent application No. 2017-171004 filed in Japan Patent Office on Sep. 6, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A compression device comprising: a compressor including a casing having a rotor chamber, a rotor that is housed in the rotor chamber inside the casing and configured to compress gas by rotating, a rotor shaft that extends from the rotor, a bearing that is provided inside the casing, on a discharge side of the compressor, and supports the rotor shaft so that the rotor is rotatable, and a first shaft-sealing part and a second shaft-sealing part that are provided to line up, on the discharge side of the compressor, between the rotor chamber and the bearing in the casing to seal a periphery of the rotor shaft; a first supply line that is adapted to supply injection oil to the rotor chamber; a second supply line that is provided independent of the first supply line and adapted to supply lubrication oil to the bearing; a third supply line that is adapted to supply sealing gas to the first shaft-sealing part; and a fourth supply line that is adapted to supply the second shaft-sealing part with sealing oil to be used for sealing at the second shaft-sealing part; and wherein the fourth supply line branches off from the first supply line and connects to the second shaft-sealing part to supply a part of the injection oil flowing in the first supply line to the second shaft-sealing part as the sealing oil.

2. The compression device according to claim 1, wherein the second shaft-sealing part is disposed between the first shaft-sealing part and the rotor in the casing.

3. The compression device according to claim 1, further comprising a return line that is adapted to supply an intake side of the rotor chamber with the injection oil having been used for the sealing at the second shaft-sealing part.

4. The compression device according to claim 1, further comprising:

a discharge line into which the compressed gas having been compressed by the rotor is discharged from the rotor chamber; and a separator that is connected to the discharge line to separate oil from the compressed gas, wherein the first supply line connects to the separator to supply the oil, which is having been separated at the separator, to the rotor chamber as the injection oil.

5. The compression device according to claim 4, wherein the compressor is configured to discharge the compressed gas to the discharge line at a higher pressure than a pressure in the second shaft-sealing part.

6. The compression device according to claim 5, wherein the compression device is configured so that the oil having been separated at the separator is supplied to the second shaft-sealing part in a state in which a pressure of the oil is maintained substantially constant.

7. The compression device according to claim 4, further comprising a pump that is connected to the first supply line to send the injection oil to the rotor chamber, wherein the fourth supply line branches off from the first supply line at a position of the first supply line between the pump and the rotor chamber.

8. The compression device according to claim 1, further comprising:

an opening control valve provided on the fourth supply line; and a control unit that controls an opening of the opening control valve so that a pressure of the injection oil supplied to the second shaft-sealing part is higher than a rotor end part pressure that is a pressure at a rotor-side end part of the rotor shaft.

9. The compression device according to claim 1, wherein the second shaft-sealing part has a labyrinth seal in which a thread groove is formed, and the thread groove has a helical shape for sending oil from the labyrinth seal to the rotor chamber-side as the rotor shaft rotates.

10. The compression device according to claim 1, further comprising a pressure control valve that is provided to the third supply line to increase a pressure of the sealing gas supplied to the first shaft-sealing part to be higher than a pressure between the first shaft-sealing part and the second shaft-sealing part.

11. The compression device according to claim 10, wherein the pressure control valve is a differential pressure-type control valve an opening of which is controlled by using the pressure between the first shaft-sealing part and the second shaft-sealing part.

12. The compression device according to claim 10, further comprising:

a pressure sensor that detects the pressure of the sealing gas supplied from the third supply line to the first shaft-sealing part;

another pressure sensor that directly or indirectly detects the pressure between the first shaft-sealing part and the second shaft-sealing part; and a control unit that performs control of causing the pressure control valve to control the pressure of the sealing gas based on the pressure detected by the pressure sensor and the pressure detected by the other pressure sensor.

13. A compression device comprising:

a compressor including a casing having a rotor chamber, a rotor that is housed in the rotor chamber inside the casing and configured to compress gas by rotating, a rotor shaft that extends from the rotor, a bearing that is provided inside the casing and supports the rotor shaft so that the rotor is rotatable, and a first shaft-sealing part and a second shaft-sealing part that are provided to line up between the rotor chamber and the bearing in the casing to seal a periphery of the rotor shaft;

a first supply line that is adapted to supply injection oil to the rotor chamber;

a second supply line that is provided independent of the first supply line and adapted to supply lubrication oil to the bearing;

a third supply line that is adapted to supply sealing gas to the first shaft-sealing part; and a fourth supply line that is adapted to supply the second shaft-sealing part with sealing oil to be used for sealing at the second shaft-sealing part, wherein the fourth supply line branches off from the first supply line and connects to the second shaft-sealing part to supply a part of the injection oil flowing in the first supply line to the second shaft-sealing part as the sealing oil, further comprising:

an opening control valve that is provided to the first supply line at a position that is located further toward an upstream side than a branching point of the fourth supply line is; and a control unit that controls an opening of the opening control valve so that a pressure of the injection oil in the first supply line is higher than a pressure at an oil inlet port of the rotor chamber and a rotor end part pressure, the oil inlet port being a port that is connected to the first supply line, the rotor end part pressure being a pressure at a rotor-side end part of the rotor shaft.

* * * * *